United States Patent [19]

von Othegraven

[11] Patent Number: 4,517,966

[45] Date of Patent: May 21, 1985

[54] APPARATUS FOR STRETCHING AND STRENGTHENING THE BACK MUSCLES

[76] Inventor: Achim von Othegraven, A-2203 Putzing 68, Putzing, Austria, A-2203

[21] Appl. No.: 435,543

[22] Filed: Oct. 21, 1982

[30] Foreign Application Priority Data

Oct. 23, 1981 [AT] Austria ..... 4541/81

[51] Int. Cl.[3] ..... A63B 23/02; A63B 21/00

[52] U.S. Cl. ..... 128/75; 272/137

[58] Field of Search ..... 272/135, 136, 137, 138, 272/139, 140, 141, 142, 93, 125, 126; 128/71, 75

[56] References Cited

U.S. PATENT DOCUMENTS

| | | | |
|---|---|---|---|
| 2,223,309 | 11/1940 | Swanson | 272/141 |
| 2,909,371 | 10/1959 | Alcover | 272/93 |
| 3,228,683 | 1/1966 | Leteff | 272/93 |
| 3,672,361 | 6/1972 | Fourneron | 272/93 |
| 4,351,527 | 9/1982 | Crisp | 272/137 |

FOREIGN PATENT DOCUMENTS

| | | | |
|---|---|---|---|
| 860811 | 1/1971 | Canada | 272/141 |
| 1460811 | 10/1966 | France | 272/141 |
| 2470612 | 6/1981 | France | 272/DIG. 5 |
| 1365888 | 9/1974 | United Kingdom | 272/141 |

*Primary Examiner*—Richard J. Johnson
*Attorney, Agent, or Firm*—Kurt Kelman

[57] ABSTRACT

Gymnastic apparatus, in particular for stretching and strengthening the back muscles, in which a support bar and a pulling bar are movable in contrary direction relative to each other against the power of a spring, in which the support bar is connected with a guiding bar containing the spring and on which the grasping bar is movable, whereby the support bar (5) is principally straight, and at one end of it is attached the guiding bar (1), preferably of a telescopic nature (2, 3) forming a T-shape.

4 Claims, 2 Drawing Figures

APPARATUS FOR STRETCHING AND STRENGTHENING THE BACK MUSCLES

The invention concerns a gymnastic apparatus, especially for stretching and strengthening the back muscles, in which a support and a pulling bar are movable in opposite directions relative to each other against the power of a spring, the support bar being connected with a guiding bar containing the spring and to which a grasping bar is moveably connected.

Because of lack of exercise, many people suffer from cramped back muscles, and therefore to circulation problems and pain. The latter is probably due to the fact that the cramped muscles put an additional load on the dorsal discs, whereby increased pressure is put on the nerve paths.

A gymnastic apparatus has been suggested with a bent support bar connected with a guiding bar, and a pressing bar movable on the latter against the power of a spring. In this apparatus, the distance between both bars, and the stroke are relatively small. The aim of this apparatus, known from the European OS 30 512 A2, is a strengthening of the thigh, abdomen and arm muscles, whereby the curved support bar is held in the knee region, in a supine position with the knees bent, and the grasping bar is pressed with the hands against the support bar. It is hardly possible to stretch and strengthen the back muscles with the known apparatus.

The aim of the invention is to suggest a gymnastic apparatus of the type referred to above, which is especially suitable for excerses designed to strengthen and stretch the back and leg muscles.

According to the invention this is achieved in that the support bar is in principle straight, and is attached to one end of the guiding bar, optionally by means of a ball-and-socket joint, whereby said guiding bar is preferably of a telescopic nature. In this way the support bar can be placed in the bend of the thighs and body and the grasping bar can be reached with upwardly stretched arms. By bending the upper body forward in a sitting position with outstretched legs, the back muscles are stretched and pressure on the dorsal discs is reduced, particularly in the area of the 5th and 6th lumbar vertebrae. This is because the point of rotation of the upper body on the one hand and that of the gymnastic apparatus on the other hand are different, and thus the spring is compressed when the body is bent forward.

If the guiding bar is connected with the support bar by means of a ball-and-socket joint, there is also the possiblity of bending forward with the apparatus on a sideways slant, so that one-sided cramps in the back muscles can be easily loosened. Further, it is advantageous if the grasping bar is swivellable and can be fixed by means of a guiding part, preferably to a rod of suchlike sliding in the tube connected with the support bar, whereby the front end of said rod is supported by the spring. This makes it possible to treat cramps in the back muscles in an exact manner.

A further feature of the invention provides for the spring to be supported on a slidable and fixable support attached to the tube connected with the support bar. In this way, it is possible to adjust the distance between the support and grasping bars, and thus an adjustment to the height of the user without alternation of the spring tension or character.

In this connection it is particularly advisable if the support is fixable by means of a threaded bolt passing through a radial threaded hold in the support and traversing into the wall of the tube.

A preferred embodiment provides for the support bar to have two rotatably attached support bodies of an especially stream-lined cross-section. In this way, the support bar does not rub on the skin, and the cross-section of the support bodies allows a good distribution of the pressure.

In order to maintain the support bodies in a particular position with relation to the guiding bar, it can further be provided for that each of the support bodies is connected with the support bar by at least one and preferably two springs tensionable in a circumferential direction, whereby in the case of two springs, these are tensioned in opposite directions to each other.

The invention is now explained in further detail with the aid of the drawing.

Figure 1:
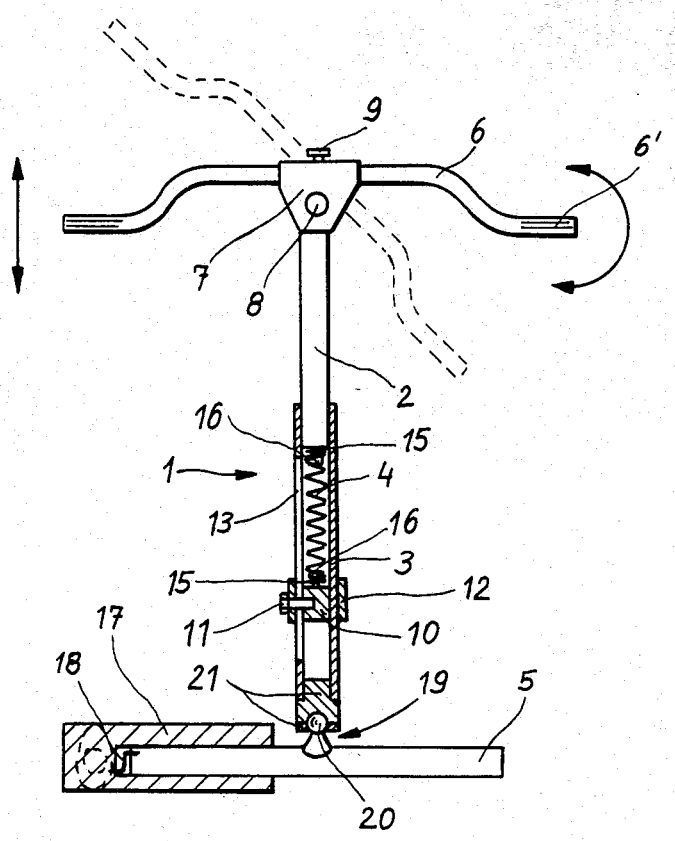
FIG. 1 shows one embodiment of the gymnastic apparatus in accordance with the invention.

In the embodiment according to FIG. 1, the guiding bar (1) is in the shape of a telescopic bar, whereby the rod 2 can be inserted into the tube 3 containing a pressure spring 4. The guiding bar 1 is connected at one end by means of a ball-and-socket joint 19 with the roller-shaped support bar 5, and has at its other end a cranked grasping bar 6. Hereby, the pin having a ball head 20 is connected with the support bar, and it is taken up by a support 21 in the guiding bar 1.

The grasping bar 6 is attached by means of a clip-shaped holding piece 7, which is swivellably and fixedly connected with the bar 1, whereby the grasping bar is swivellable around an axis 8, running vertically to the axis of the guiding bar 1 and vertically to the axis of the grasping bar 6. Thus, the axis 8 can for example be in the form of a threaded bolt, whereby the holding piece 7 is fixed by means of tightening a nut (not shown in the drawing) on the threaded bolt.

The grasping bar 6 is also held turnably and fixedly in the holding piece 7, whereby a screw 9 is provided for fixing purposes, which transverses a threaded hole in the holding piece 7.

Figure 2:
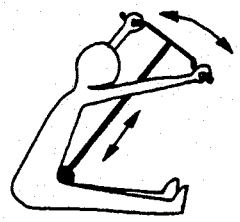
FIG. 2 is a sketch of the apparatus in use.

As can be seen from FIG. 2, when exercising with the gymnastic apparatus according to FIG. 1, the support bar 5 is placed in the bend between the upper body and the thighs, and the grasping bar 6 is grasped with both hands, arms stretched, in an upright sitting position.

The upper body and the bar 1 can be swivelled around points of rotation at a distance from each other. If, however the upper body is bent forward together with the bar 1, then the bar 1 must be shortened, which is only possible when the spring 4 is compressed. This results in an increasingly stronger pull on the spine and the muscles of the back, via the arms, thus decreasing the load on the dorsal discs and loosening the back muscles.

Adjacent to the height of the user can, in the embodiment according to FIG. 1, on the one hand be carried out by turning the grasping bar 6, whereby the distance between the handles 6' and the supporting bar 5 is altered, or by moving the support 10 of the spring 6. For this, it is sufficient to loosen the threaded bolt 11, which transverses a hole through a ring 12 sliding on the outer surface of the tube 3 and a slot 13 in the tube 13, and engages a threaded hole 14 in the support 10. Thus, the support 10 can be shifted and then fixed by tightening the threaded bolt 11.

In order to avoid the bar 2 from being separated from the rest of the apparatus, projections 16 with grooves 15 are provided at the front end of the support 10 and the bar 3, whereby the end windings of the spring 4 engage in the grooves 15.

FIG. 1 also indicates a possibility of rotatably arranging support bodies 17 on the support bar 5. Such support bodies 17 have preferably, as indicated by dotted lines, a stream-lined cross section. Apart from this, they can be held in a particular position relative to the guiding bar 1 by means of a tensionable spring 18 in the circumferential direction of the support bar 5.

Basically, the guiding bar 1 can be rigidly connected with the support bar, whereby the guiding bar 1 stands at a vertical angle from the support bar.

I claim:

1. A gymnastic apparatus for stretching and strengthening the back muscles, which comprises (a) a substantially rectilinearly extending support bar having two ends, (b) a telescopic back tensioning bar having an axis and forming a T-shape with the support bar, the back tensioning bar comprising (1) two telescoping members extending along said axis, one of the telescoping members being a tube and the other telescoping member being a rod extending into the tube and rotatable in relation thereto about the axis of the back tensioning bar, the support bar being connected to the one telescoping member, and (2) a compression spring biasing the other telescoping member in a direction away from the support bar, (c) a handle bar at an end of the other telescoping member remote from the one telescoping member, the handle bar being farther spaced from the support bar when the spring is uncompressed than when it is compressed, (d) a holder attached to the end of the other telescoping member, the holder receiving the handle bar, (e) means for fixing the holder in a selected position, and (f) a support sleeve rotatably mounted on each end of the support bar.

2. The gymnastic apparatus of claim 1, wherein the handle bar is cranked.

3. The gymnastic apparatus of claim 1, further comprising a ball-and-socket joint connecting the one telescoping member of the tension bar to the support bar.

4. The gymnastic apparatus of claim 1, wherein the handle bar is rotatable about an axis extending perpendicularly to the tension and handle bars.

* * * * *